US009500373B2

(12) United States Patent
Gabel et al.

(10) Patent No.: US 9,500,373 B2
(45) Date of Patent: Nov. 22, 2016

(54) FIREPLACE

(75) Inventors: Falk Gabel, Schlangenbad (DE); Roland Leroux, Stadecken-Elsheim (DE);
(Continued)

(73) Assignee: SCHOTT AG, Mainz (DE)

( * ) Notice: Subject to any disclaimer, the term of this patent is extended or adjusted under 35 U.S.C. 154(b) by 871 days.

(21) Appl. No.: 13/699,929

(22) PCT Filed: Apr. 29, 2011

(86) PCT No.: PCT/EP2011/056873
§ 371 (c)(1),
(2), (4) Date: Mar. 19, 2013

(87) PCT Pub. No.: WO2011/147659
PCT Pub. Date: Dec. 1, 2011

(65) Prior Publication Data

US 2013/0213386 A1 Aug. 22, 2013

(30) Foreign Application Priority Data

May 26, 2010 (DE) ..... 10 2010 017 987

(51) Int. Cl.
*F24B 1/18* (2006.01)
*F24B 1/188* (2006.01)
(Continued)

(52) U.S. Cl.
CPC ..... *F24B 1/1881* (2013.01); *F23M 5/00* (2013.01); *F24B 1/195* (2013.01); *F23M 2900/05004* (2013.01)

(58) Field of Classification Search
CPC ..... F24B 1/1881; F24B 1/195; F23M 5/00; F23M 2900/05004; C04B 35/00
(Continued)

(56) References Cited

U.S. PATENT DOCUMENTS 374,649 A * 12/1887 Backus ..... F24B 1/183 126/512
556,807 A * 3/1896 Connell et al. ..... F24B 1/1881 126/514
(Continued)

FOREIGN PATENT DOCUMENTS

DE 2745461 3/1979
DE 3123568 6/1982
(Continued)

OTHER PUBLICATIONS

"DE_2745461_B1_M—Machine Translation.pdf", machine translation, EPO, Nov. 18, 2015.*
(Continued)

*Primary Examiner* — Gregory Huson
*Assistant Examiner* — Daniel E Namay
(74) *Attorney, Agent, or Firm* — Ohlandt, Greeley, Ruggiero & Perle, LLP

(57) ABSTRACT

A fireplace is provided that includes a combustion space delimited by a combustion-space lining and accessible through a door or flap. The combustion-space lining is at least partially composed of a ceramic or glass-ceramic material. The fireplace also includes a wall element disposed on a side of the combustion-space lining that faces away from the combustion space so that an intermediate space is formed between the side and the wall element. A heat exchanger or insulating material ca n be positioned in the intermediate space.

17 Claims, 1 Drawing Sheet

(75) Inventors: Torsten Gabelmann, Wiesbaden (DE)

Figure 1:
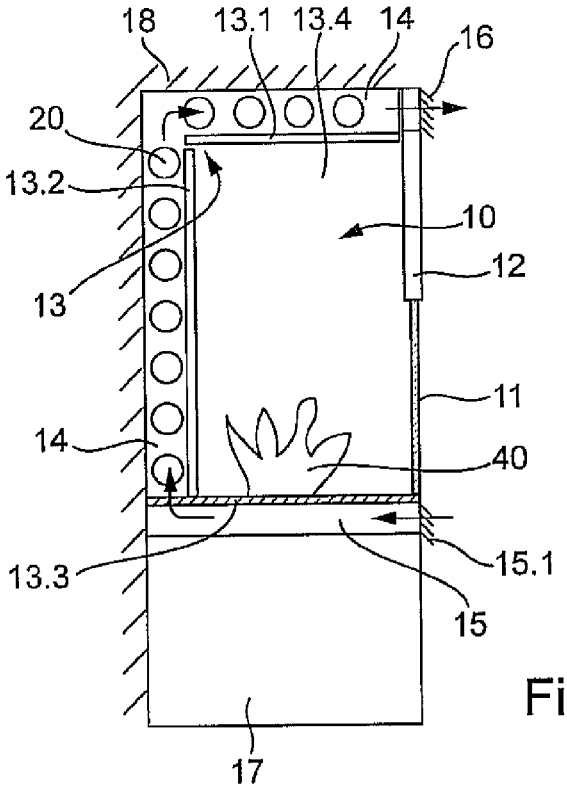

(51) Int. Cl.
*F24B 1/195* (2006.01)
*F23M 5/00* (2006.01)
*C04B 35/115* (2006.01)

(58) Field of Classification Search
USPC ..... 126/531, 528, 529, 34
IPC ..... F24B 1/18,1/188, 1/95; F23M 5/00; C04B 35/115
See application file for complete search history.

(56) References Cited

U.S. PATENT DOCUMENTS 1,505,064 A * 8/1924 Thorne ..... F24B 1/195 126/540
3,181,526 A * 5/1965 Ruegg ..... F24B 1/1802 126/512
4,224,921 A * 9/1980 Petrescue ..... F24B 1/1885 126/518
4,272,238 A * 6/1981 Smith ..... F23D 14/16 431/328
4,436,079 A 3/1984 Piazetta et al.
5,339,797 A * 8/1994 Maitland ..... F24B 1/195 126/312
5,594,999 A * 1/1997 Best ..... F24C 15/24 34/270
5,901,701 A 5/1999 Wade
5,960,781 A * 10/1999 Walter ..... F24C 3/087 126/21 R
6,374,822 B1 * 4/2002 Lyons ..... F23M 5/00 126/500
6,418,973 B1 * 7/2002 Cox ..... B32B 5/26 139/383 R
2002/0023463 A1 2/2002 Siebers et al.
2003/0211354 A1 * 11/2003 Subramanian ..... C23C 4/04 428/633
2005/0199233 A1 * 9/2005 Butler ..... F24B 1/1881 126/523
2006/0065173 A1 * 3/2006 Makela ..... F23C 10/18 110/343
2007/0042896 A1 * 2/2007 Peascoe-Meisner .. C04B 35/443 501/119
2007/0232476 A1 * 10/2007 Siebers ..... C03C 3/095 501/4
2008/0076084 A1 * 3/2008 Schubach ..... F23M 5/00 432/1
2008/0156892 A1 * 7/2008 Eberhardt ..... F24B 1/1881 237/81
2008/0163863 A1 7/2008 Thomas
2008/0181587 A1 * 7/2008 Patil ..... F24C 7/004 392/348
2008/0181588 A1 * 7/2008 Gorby ..... F24C 7/004 392/348
2009/0320824 A1 * 12/2009 Henn ..... C03C 17/3417 126/500
2010/0229849 A1 * 9/2010 Asofsky ..... F24C 7/004 126/500
2011/0088683 A1 * 4/2011 Spadaro ..... F24B 1/195 126/500
2012/0094079 A1 * 4/2012 Gabel ..... C03B 29/08 428/157

FOREIGN PATENT DOCUMENTS

DE 3525617 1/1987
DE 19801079 7/1999
DE CA 2422405 A1 * 3/2003 ..... C03C 4/02
DE 10208089 9/2003
DE 102007025893 12/2008
DE 102008025157 12/2009
EP 0930465 7/1999
JP S61143654 A 7/1986
JP H09229335 A 9/1997
JP H09292180 A 11/1997
JP H108131 A 1/1998
JP 2001354446 A 12/2001
JP 2004523446 A 8/2004
WO WO 0216279 A1 * 2/2002 ..... C03C 4/02

OTHER PUBLICATIONS

"DE_3525617_A1_M—Machine Translation.pdf", machine translation, EPO, Nov. 18, 2015.*
"DE_102008025157_Al_M—Machine Translation.pdf", machine translation, EPO, Nov. 18, 2015.*
English translation of the Written Opinion of the International Searching Authority dated Jul. 4, 2012 for corresponding International Application No. PCT/EP2011/056873, 7 pages.
English translation of the International Preliminary Report on Patentability dated Nov. 27, 2012 for corresponding International Application No. PCT/EP2011/056873, 8 pages.
English translation of the International Search Report from corresponding International Application No. PCT/EP2011/056873 dated Jul. 4, 2012.

* cited by examiner

FIREPLACE

The invention relates to a fireplace, in particular a single-chamber fireplace, having a combustion space that is delimited by a combustion-space lining and is accessible by a door, the combustion-space lining being at least partially composed of a ceramic or glass-ceramic material, and a wall element being arranged, at least in some regions, on the side facing away from the combustion space behind the combustion-space lining made of ceramics or glass ceramics.

In today's fireplaces, fireproof materials that are associated either with the group of natural or technical silicates are used in the combustion space.

Natural silicates include so-called aluminosilicates, in which silicon is partially replaced by aluminum. For example, these include neo, phyllo and tectosilicates, such as mica, sillimanite, mullite and feldspars. Vermiculite, a phyllosilicate, which is a mineral present in nature and which forms by weathering (mica schist) and has the following chemical formula: $(Mg,Ca,K,Fe)_3(Si,Al,Fe)_4O_{10}(OH)_2O_4H_2O$ has achieved technical importance as a heat insulation material. The chemically bound water is expelled abruptly by means of special heat treatment, the vermiculite being expanded 10 to 35 times its volume. The expanded vermiculite is available for the most part as granulate, but partially also as sheets, and is frequently used as a combustion-space lining due to its low price.

Overall, these silicates that are used as combustion-space linings or fireproof materials have in common a low resistance to temperature fluctuations (<500° C.), a high expansion coefficient (as a rule $>10\times10^{-6}K^{-1}$), a low chemical resistance, and a high porosity. Because of this, they have limited usefulness as a combustion-space lining.

Ceramic products that are classified as technical silicates are more advantageously suitable, especially in relation to their thermal expansion coefficients. Cordierite ceramics (CTE approx. $3\times10^{-6}K^{-1}$, magnesium aluminium silicates), which are formed directly during the sintering of soapstone or talc with additions of clay, kaolin, chamotte, corundum and mullite, are particularly mentioned here. A simplified approximation of the composition of pure ceramic cordierite is approximately 14% MgO, 35% $Al_2O_3$ and 51% $SiO_2$.

Ceramic products are produced by firing, clays with additives such as, e.g., quartz sand or powder being processed. Fireproof products are used in the combustion space of a fireplace. Belonging to the most commonly used products are so-called fire bricks. These are obtained by firing a mixture of crude plastic clay and strongly fired, coarse, crushed fireproof clay at high temperature. A qualitatively high-quality fire brick (higher application temperature) is characterized by an $Al_2O_3$ fraction that is as high as possible, in order to form as much mullite $3Al_2O_3*2SiO_2$ as possible.

Despite the better resistance to temperature fluctuations due to their thermal expansion coefficients, these materials have in common a significant porosity due to their production by the sintering process. This leads to a low mechanical and chemical resistance especially in connection with corrosive gases in the combustion space of fireplaces.

Glasses, in particular glass ceramics, combine all essential properties in order to be suitable as materials for combustion-space linings. In particular, the small thermal expansion coefficient ($<1.5\times10^{-6}K^{-1}$), the lack of porosity, the high resistance to temperature fluctuations (up to 800° C.), as well as the chemical and mechanical resistance characterize these materials for this application.

Glasses and glass ceramics are classified as technical silicates. In particular, special glasses with very specific properties suitable for special objectives may be of interest for applications in the fireplace. Here, glass ceramics should be mentioned, such as those that already find use, e.g., as viewing windows.

Such a fireplace is known from DE 198 01 079. In this case, a construction is used, in which a glass-ceramic molded piece is introduced on fire bricks. The fire bricks are arranged in the combustion space so that the glass-ceramic molded pieces delimit the combustion space. For better efficiency, the glass-ceramic molded pieces are provided with a coating that reflects IR radiation.

In addition, fireplaces are known from the prior art, the combustion space of which is delimited by heat-retaining or heat-insulating materials. In particular, chamotte, vermiculite, calcium silicate plates or sillimanite is or are used currently for this purpose. If the device/the fireplace has an additional mechanism for heating/warming of water or air, e.g., a heat exchanger, then the latter is predominantly positioned above the fireplace in the combustion space. For example, DE 31 23 568 describes a fireplace with an intermediate space, in which a heat exchanger through which a fluid flows is heated via circulating air.

An additional module that can be plugged onto a commercial fireplace in order to utilize the waste heat of the flue gases for heating water is known from DE 102 08 089.

In addition, water heat exchangers that are formed by water-conducting walls are known from the prior art. In this case, the water-conducting walls are connected to the combustion space.

The object of the invention is to create a fireplace of the type mentioned initially, which makes possible a higher output yield with improved functionality.

This object is achieved in that the wall element is arranged at a distance from the associated combustion-space lining made of ceramics or glass ceramics, so that an intermediate space is formed. The intermediate space can be utilized, for example, for heat transmission by decoupling heat energy from the combustion space via the ceramics or glass ceramics and introducing it into the intermediate space. The heat input into the intermediate space can be controlled via the configuration of the ceramics or glass ceramics, depending on the application. On their side facing the combustion space, the ceramics or glass ceramics form an easy-to-clean surface, from which troublesome soot deposits can be removed simply with a broom or conventional glass cleaning agents. It is assured in this way that an efficiency that remains equally high can be achieved. With room heaters having small combustion spaces, in particular, an optical magnification of the combustion space will be achieved due to the mirror-like surface of glass ceramics. The fire can also be viewed from lateral positions, which is not possible without further steps in the absence of the combustion-space lining according to the invention.

According to a preferred variant of the invention, it is provided that a heat exchanger is disposed in the intermediate space between the ceramics or glass ceramics and the wall element. In this case, the heat exchanger can be designed, e.g., as an air/water heat exchanger (or other media, e.g., oil). It is also conceivable, however, that an air/air heat exchanger is positioned in the intermediate space. IR radiation is decoupled from the combustion space via the ceramics or glass ceramics. This acts on the heat exchanger and heats the heat-exchanger medium that flows in the heat exchanger. In contrast to the prior art, the advantage is now offered in that an improved efficiency of the heat exchanger can be driven/obtained/achieved by means of conducting the IR radiation through the ceramics or glass ceramics. The heat exchanger is also accommodated protected from corrosion behind the ceramics or glass ceramics. If the heat exchanger is designed as an air/water heat exchanger, then a convective component can also be used for heating the heat exchanger. Correspondingly, if a flow of air is produced in the intermediate space, the heated air will be conducted past the heat-exchanger surfaces.

A particularly preferred variant of the invention is one in which the combustion-space lining is partially transparent to IR radiation or is provided with a coating that absorbs IR radiation. In this way, it is assured that a part of the IR radiation from the combustion space reaches into the intermediate space through the ceramics or glass ceramics. Additionally, the ceramics or glass ceramics absorb a portion of the IR radiation. As a consequence of the absorption of IR radiation, the ceramics or glass ceramics heat up, whereby an additional input of energy into the intermediate space and thus into a heat exchanger arrangement optionally disposed in the intermediate space is made possible.

A fireplace according to the invention can be configured so that an air-conduction channel is formed in the intermediate space. This air-conduction channel is connected to the ambient environment, so that an additional convective heating of the installation zone in which the fireplace is accommodated can be achieved. It is also conceivable that the air-conduction channel is connected to an external heat exchanger.

An embodiment variant is particularly preferred in which the heat exchanger is disposed in the air-conduction channel. In this way, the heat exchanger is heated both with IR radiation as well as convectively, and a construction that saves space becomes possible.

According to an alternative variant of the invention, it may be provided that the intermediate space is filled, at least in some regions, with an insulating material in the form of a bulk material or in the form of a pliable mat. In this variant, high temperature-resistant ceramics or glass ceramics offer the advantage that the inner space of the fireplace is easy to clean and that the optics are improved. Materials that are not currently used in oven construction can be utilized for heat insulation for oven or fireplace insulation. It is conceivable to accommodate granulate, sand, or other bulk material, fiber mats or sheets, or, e.g., hollow beads in the intermediate space. These can bring about a considerable reduction in weight of the oven and thus make it lighter and more transportable. It is conceivable that wall elements will be configured, in which the ceramics or glass ceramics, the introduced insulation material and the wall element form a closed structural unit, which can be uniformly handled and installed.

The invention will be explained in further detail in the following on the basis of examples of embodiment shown in the drawings.

Figure 2:
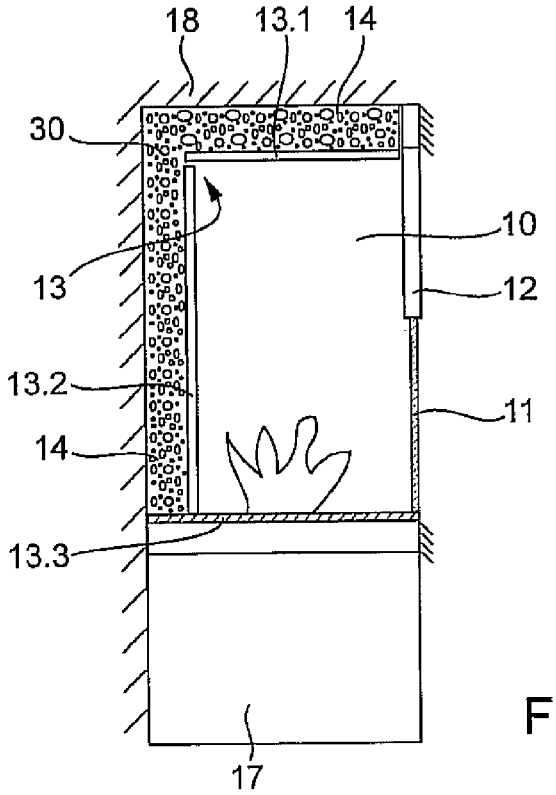

Herein:

FIG. 1 in schematic lateral view and in section shows a fireplace with an air/water heat exchanger and FIG. 2 in schematic lateral view and in section shows a fireplace with thermal insulation.

FIG. 1 shows a fireplace, as is typically used in a residence/residential interiors. This fireplace has a combustion space 10, which is surrounded by a combustion-space lining 13. On the front, combustion space 10 is accessible through a door 11 with a viewing window made of glass ceramics or glass material. Above door 11 is provided a front lining 12 that can be formed by a fire brick or a cast iron material and is particularly designed conventionally.

The combustion-space lining 13 in the present case comprises five plates made of ceramic or glass-ceramic material. Correspondingly, a top-side plate 13.1, a rear wall 13.2, a bottom 13.3, and two vertical side walls 13.4 are provided. The top-side plate 13.1 and the rear wall 13.2 are installed in parallel but at a distance to wall elements 18 of the fireplace. In this way, an intermediate space 14 results. Bottom 13.3 is found parallel but at a distance to a boundary wall of a base 17. In this way, an intermediate space 14 is formed between bottom 13.3 and the boundary wall, and this space is designed as an air-conduction channel 15. This air-conduction channel 15 is spatially connected to the vertical intermediate space 14, as can be seen by the arrows. On the front side, air-conduction channel 15 is spatially connected via an inlet 15.1 with the zone in which the fireplace is installed. Also, an intermediate space 14 that is spatially connected with the installation zone on the front side via an outlet 16 is formed between the top-side plate 13.1 and the wall element 18 associated with it. The intermediate spaces 14 and the air-conduction channel 15 form an air-conduction system through which ambient air can be circulated.

A heat exchanger 20 is accommodated in intermediate space 14. Heat exchanger 20 in the present case is designed as an air/water heat exchanger. It has pipes that are placed in intermediate space 14. Water can be circulated through these pipes, to which, for example, a pump is connected externally.

During operation of the fireplace, a fire 40, which emits IR radiation, arises in combustion space 10. This IR radiation is decoupled by the ceramics or glass ceramics of the combustion-space lining 13 that are partially transparent to IR radiation (top-side plate 13.1, rear wall 13.2 and side walls 13.4) and introduced into the associated intermediate spaces. There, the IR radiation strikes heat exchanger(s) 20 and heats it (them) and thus heats the heat-exchanger material introduced in heat exchangers 20. The ceramic or glass-ceramic plates of the combustion-space lining 13 can be provided, in particular, with a coating that absorbs IR radiation, so that the ceramics or glass ceramics are heated via the absorption process. In this way, a heated surface on which circulating air can be heated is formed facing air-conduction channel 15. This has the advantage that heat exchanger 20 can be additionally heated via convection processes. Especially in the heating-up phase of the fireplace, a high input of energy into the storage medium (water) can thus result. The heated air can additionally be utilized for heating the room by delivering it into the room via outlet 16.

FIG. 2 shows another variant of an embodiment of a fireplace that is constructed substantially identical to the fireplace according to FIG. 1. Only the intermediate space 14 between top-side plate 13.1, rear wall 13.2, side walls 13.4 and wall elements 18 associated with each of these is configured differently. Whereas, in the embodiment according to FIG. 1, a heat exchanger 20 is provided, intermediate spaces 14 according to FIG. 2 are filled with an insulation material 30 in the form of a bulk material, i.e., particularly in the form of granulates. Instead of the bulk material, a pliable insulation mat may also be disposed behind the ceramic or glass-ceramic plates of combustion-space lining 13 in intermediate space 14. This pliable mat is supported and held on one side by combustion-space lining 13 and, on the other side, by wall element 18.

In some embodiments, the combustion-space lining (13) includes a glass-ceramic material that contains keatite mixed crystal as a principal crystalline phase. In other embodiments, the combustion-space lining (13) includes a glass-ceramic material that has a principal crystalline phase of keatite mixed crystals and a second crystalline phase of high quartz mixed crystals. The glass-ceramic material of the combustion-space lining (13) can have a ratio between the second crystalline phase and the primary crystalline phase that increases continuously toward an edge of the glass-ceramic material. The secondary crystalline phase can include a phase such as gahnite mixed crystals, zirconium titanate mixed crystals, titanium oxide mixed crystals up to mullite, Celsian-like crystalline phases, and combinations thereof. In some embodiments, a region on an edge has an extensively amorphous structure.

In other embodiments, the combustion-space lining (13) includes a glass-ceramic material that includes one of cordierite, mullite, quartzal, sintered silica glass, vermiculite, chamotte, and silica glass. In still other embodiments, the combustion-space lining (13) includes a ceramic material that has a material including spinel, mica, and feldspars.

The invention claimed is:

1. A fireplace, comprising:

a combustion space that is delimited by a combustion-space lining and is accessible by a door or a flap, the combustion-space lining being at least partially composed of a ceramic or glass-ceramic material; and a wall element being disposed on a side of the combustion-space lining that faces away from the combustion space so that an intermediate space is formed between the side and the wall element, wherein the combustion-space lining is partially transparent to IR radiation.

2. The fireplace according to claim 1, further comprising a heat exchanger disposed in the intermediate space.

3. The fireplace according to claim 2, wherein the heat exchanger is an air/water heat exchanger.

4. The fireplace according to claim 2, further comprising an air-conduction channel formed in the intermediate space.

5. The fireplace according to claim 4, wherein the heat exchanger is disposed in the air-conduction channel.

6. The fireplace according to claim 1, wherein the intermediate space is filled, at least in some regions, with an insulating material in the form of a bulk material.

7. The fireplace according to claim 1, wherein the intermediate space is filled, at least in some regions, with an insulating material in the form of a pliable mat.

8. The fireplace according to claim 1, wherein the combustion-space lining comprises a glass-ceramic material that contains high quartz mixed crystal as a principal crystalline phase.

9. The fireplace according to claim 1, wherein the combustion-space lining comprises a glass-ceramic material that contains keatite mixed crystal as a principal crystalline phase.

10. The fireplace according to claim 1, wherein the combustion-space lining comprises a glass-ceramic material having a principal crystalline phase of keatite mixed crystals and a second crystalline phase of high quartz mixed crystals.

11. The fireplace according to claim 10, further comprising a ratio between the second crystalline phase and the primary crystalline phase that increases continuously toward an edge of the glass-ceramic material.

12. The fireplace according to claim 10, further comprising a ratio between the second crystalline phase and the primary crystalline phase that increases in steps toward an edge of the glass-ceramic material.

13. The fireplace according to claim 10, further comprising, as secondary phases, a phase selected from the group consisting of gahnite mixed crystals, zirconium titanate mixed crystals, titanium oxide mixed crystals up to mullite, Celsian-like crystalline phases, and combinations thereof.

14. The fireplace according to claim 13, further comprising a region on an edge with an extensively amorphous structure.

15. The fireplace according to claim 1, wherein the combustion-space lining comprises a ceramic material selected from the group consisting of cordierite, mullite, quartzal, sintered silica glass, vermiculite, chamotte, and silica glass.

16. The fireplace according to claim 1, wherein the combustion-space lining comprises a ceramic material that comprises a material selected from the group consisting of spinel, mica, and feldspars.

17. A fireplace, comprising:

a combustion space that is delimited by a combustion-space lining and is accessible by a door or a flap, the combustion-space lining being at least partially composed of a ceramic or glass-ceramic material, wherein the combustion-space lining comprises a glass-ceramic material that contains keatite mixed crystal as a principal crystalline phase and a second crystalline phase of high quartz mixed crystals; and a wall element being disposed on a side of the combustion-space lining that faces away from the combustion space so that an intermediate space is formed between the side and the wall element.

* * * * *